US005239972A

United States Patent [19]

Takeyama et al.

[11] Patent Number: 5,239,972

[45] Date of Patent: Aug. 31, 1993

[54] GAS/LIQUID SEPARATION DEVICE

[75] Inventors: Masaki Takeyama, Okazaki; Toshihiko Igashira, Toyokawa; Toru Yoshinaga; Masahiro Takigawa, both of Okazaki, all of Japan

[73] Assignee: Nippon Soken, Inc., Nishio, Japan

[21] Appl. No.: 856,769

[22] Filed: Mar. 24, 1992

[51] Int. Cl.[5] ..... F02B 25/06

[52] U.S. Cl. ..... 123/573; 123/41.86

[58] Field of Search ..... 123/41.86, 572, 573, 123/574

[56] References Cited

U.S. PATENT DOCUMENTS 4,947,806 8/1990 Speer et al. ..... 123/41.86

FOREIGN PATENT DOCUMENTS 59-208116 11/1984 Japan .
59-206610 11/1989 Japan .
3-74508 3/1991 Japan .

OTHER PUBLICATIONS

"New Type Car Manual for Toyota Estima Lucida" published by Toyota Motor Corp. Jan. 13, 1992 p. 2-65, p. 2-104.

*Primary Examiner*—Noah P. Kamen
*Attorney, Agent, or Firm*—Cushman, Darby & Cushman

[57] ABSTRACT

A gas/liquid separator device includes a separator, such as a cyclone type separator, provided in a blowby gas passage for introducing a blowby gas from a blowby gas chamber of an internal combustion engine, an oil accumulator in the form of a container for accumulating separated and condensed oil mist, another passage provided separately from the blowby gas passage for returning the oil from the oil accumulator to an oil collection chamber, and a communication blocking element for blocking a communication between the oil accumulator and the oil collection chamber while the engine is running.

7 Claims, 9 Drawing Sheets

GAS/LIQUID SEPARATION DEVICE

BACKGROUND OF THE INVENTION

1. Field of the Invention

The present invention relates to a gas/liquid separation device. More particularly, the invention relates to a gas/liquid separation device applicable to a crankcase emission control system. The device separates oil mist from blowby gas of an internal combustion engine and recirculates it to an oil collection chamber.

2. Description of the Related Art

A crankcase emission control system for introducing blowby gas from a crank chamber, or a head cover of a cylinder head in communication with the crank chamber, into an air induction passage are known in the art (for example, see Japanese Unexamined Patent Publication (Kokai) No. 59-208116). It is also known in the art to provide an oil trap in a blowby gas recirculation passage for trapping an oil mist carried by the blowby gas, and separate them from each other (for example, see Japanese Unexamined Patent Publication No. 59-206610).

When the blowby gas is treated simply by a recirculation thereof into the air induction passage, the oil mist carried by the blowby gas is also introduced into the air induction passage. This increases the consumption of engine lubrication oil. Also, the oil or decomposition products thereof may adhere to the inner peripheral wall of the air induction system. In the worst case, the oil and/or decomposition products may accumulate on the inner periphery of the air induction passage and cause various problems. Therefore, there is a need for separating the oil mist from the blowby gas to be introduced into the air induction passage, and for returning the oil to the lubricant collector.

The oil mist can be collected or recovered by various means, such as an oil trap with a baffle plate. However, it is difficult to return the collected oil to the crank chamber or the head cover through the same piping, against the flow of the blowby gas, unless the piping is large. Therefore, in the prior art, the collected oil is held in an oil strainer while the engine is running. It is returned to the oil collection chamber in the crank chamber under the force of gravity when the engine is not running.

Accordingly, when the engine is driven for a long period, the amount of oil adhered to the oil strainer is increased to the point of saturation. Once the oil strainer is saturated, a balance is established between the amount of oil mist to be collected and the amount of oil again atomized by the flow of the blowby gas. Therefore, it becomes impossible to further collect the oil mist.

SUMMARY OF THE INVENTION

Therefore, an object of the present invention is to provide a gas/liquid separation device which can effectively recirculate a collected liquid, such as an oil, to a container, such as an oil collection chamber. Thus, the liquid separated from a gas, such as a blowby gas, is not again atomized to be again carried by the gas flow.

Another object of the present invention is to provide a crankcase emission control system for an internal combustion engine, which incorporates the improved gas/liquid separation device.

A further object of the invention is to provide a crankcase emission control system which returns the accumulated oil separated from the blowby gas passage.

It is thus unnecessary to return the accumulated oil through the blowby gas passage, against the flow of the blowby gas.

Yet a further object of the present invention is to provide a crankcase emission control system which can smoothly recirculate the blowby gas in an air induction passage, and can thus maintain the emission of the engine at a satisfactorily low level.

Another further object of the present invention is to provide a crankcase emission control system which can smoothly return the oil separated from the blowby gas to the oil collection chamber in the engine. This occurs regardless of a pressure difference that may interfere with the natural flow of the collected oil, and thus does not require a particular pumping means.

Other objects of the present invention will become clear from the detailed description given herebelow.

To accomplish the above-mentioned and other objects according to one aspect of the present invention, there is provided a gas/liquid separation device comprising a cyclone type separator means disposed within a first passage, through which a gas carrying an oil component flows, for collecting the oil component; a first oil accumulation means for converging the separated oil; a second passage means independent of the first passage, for communicating with a center portion of a swirl flow in the cyclone type separator means; and a second oil accumulation means incorporating a communication blocking means disposed in the second passage, for blocking a communication between the second passage and an oil collection chamber of an engine.

In the preferred construction, the cyclone type separator means comprises a cylindrical casing; a gas induction path opening into said casing so as to introduce therein the gas to be treated in a tangential direction; a gas discharge path for the gas directed to the first oil accumulation means, opening above the center position of the casing; and another passage means open at one end to the center position of the gas discharge path.

According to another aspect of the invention, a crankcase emission control system for an internal combustion engine comprises separator means provided in a blowby gas passage for introducing a blowby gas from an upper space of a crank chamber of the engine, or a blowby gas chamber within a head cover of a cylinder head; oil accumulation means in a form of a container for converging and accumulating separated and condensed oil mist; another passage provided separately from the blowby gas passage for returning the oil from the oil accumulation means to an oil collection chamber; and communication blocking means for blocking a communication between said oil accumulation means and the oil collection chamber at least while the engine is running.

With the crankcase emission control system, according to the present invention, the blowby gas is recirculated from the upper space of the crank chamber of the engine, or the blowby gas chamber in the head cover of the cylinder head in communication with the crank chamber, to an air induction passage through the blowby gas passage. It is then introduced into a combustion chamber of the engine to be burned together with an air/fuel mixture.

The oil mist carried by the blowby gas is collected by the separator means provided in the blowby gas passage and condensed into an oil film. The oil film is then converged and flows into the oil accumulation means.

The oil accumulation means in a container form is formed at the bottom of the separator means and is designed to store a large amount of oil. The oil in the oil accumulator forms substantially a flat surface, so that little thereof is atomized by the blowby gas flow.

The oil accumulated in the oil accumulation means is then returned to the oil collection chamber of the engine through a second passage means separated from the blowby gas passage. The second passage means is provided with the communication blocking means. Thus, the pressure difference generated when recirculating the blowby gas to the air induction passage, i.e., the pressure differential, will not influence the operation of the separator means and the oil accumulation means. This is because the pressure in the crank chamber or the blowby gas chamber, as well as the oil collection chamber, is higher than that in the separator means or the air induction passage. Accordingly, the presence of the separator means and the oil accumulation means does not affect the flow of the blowby gas in the blowby gas passage. Therefore, the accumulated oil can be smoothly returned to the oil collection chamber from the oil accumulation means during engine operation or while the engine is not running.

When the accumulated oil is returned during engine operation, the communication blocking means may operate like a vane or piston. This would separate the induction opening and the discharge opening of a vacuum pump. Further, when the accumulated oil is returned while the engine is not running, since the pressure for recirculating the blowby gas does not exist, the accumulated oil can be returned under the force of gravity to the oil collection chamber. As can be seen from the above, the communication blocking means can act as a non-return valve or a float valve. This maintains the pressure difference and smoothly recirculates the blowby gas. By providing the passage for returning the oil and the communication blocking means, no interference with the flow of the blowby gas occurs during the engine operation. Also, the accumulated oil can be successfully and smoothly returned from the oil accumulation means to the oil collection chamber.

BRIEF DESCRIPTION OF THE DRAWINGS

The present invention will be more fully understood from the detailed description given below and from the accompanying drawings of the preferred embodiment of the invention. These do not limit the invention, but are for explanation and understanding only.

In the drawings.

DESCRIPTION OF THE PREFERRED EMBODIMENTS

Figure 1:
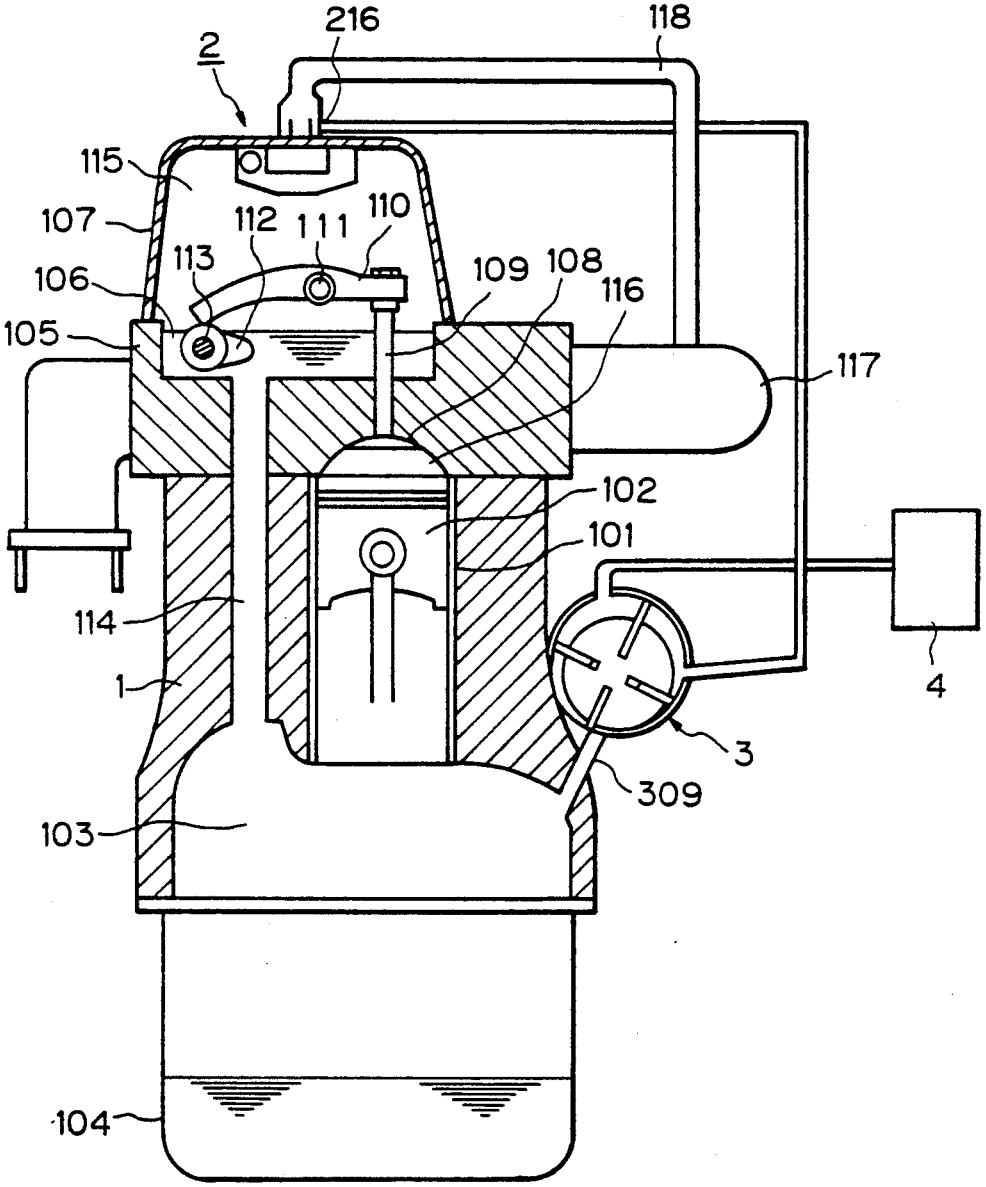
FIG. 1 is a longitudinal section showing an overall construction of an internal combustion engine, to which the first embodiment of a crankcase emission control system according to the present invention is applied.

Referring now to the drawings, FIG. 1, illustrates a first embodiment of a crankcase emission control systems, according to the present invention. A diesel engine body 1 has engine cylinders 101 in which pistons 102 are reciprocally received, and a crank chamber 103 is defined below the cylinders 101. The crank chamber 103 defines an upper space above an oil pan 104 which stores a lubrication oil. The lubrication oil is supplied between the piston 102 and inner periphery of the cylinder 101 for lubrication therebetween. A cylinder head 105 defines a recess 106 on the upper surface for forming an oil collection chamber 106. A cover 107 is provided over the oil collection number 106. The oil in the oil pan 104 is supplied to respective lubricating portions of respective cam bearings of the cylinder head 105, by an oil pump (not shown). The lubricant oil accumulated in the oil collection chamber 106 after lubrication flows into the oil pan 104 via an oil passage 114. Thus, the oil is recirculated to the oil pan 104.

A blowby gas chamber 115 is defined in a space between the oil collection chamber 106 and the head cover 107, and is in communication with an air induction passage 117 through a blowby gas recirculation passage 118. A blowby gas passing through a gap between the inner periphery of the combustion chamber 116 and piston rings (not shown) of the piston 102, flows through the passage 114 and absorbs the oil mist. The blowby gas carrying the oil mist is separated from the oil mist by an oil separator 2; this is a particular feature of the present invention. Thereafter, the blowby gas including substantially no oil mist is recirculated into the air induction passage 117 through the blowby gas recirculation passage 118.

Note, in FIG. 1, reference numeral 108 denotes an intake valve or an exhaust valve, 109 denotes a stem portion of the valve, 111 denotes a rocker arm, 112 denotes a cam, and 113 denotes a camshaft. These elements are formed and assembled into the engine in a manner well known per se.

Next, the construction of the oil separator 2 will be discussed below with reference to FIG. 2. As is shown, the oil separator 2 is a cyclone type and comprises a swirl generator device 201 and a drawing type trapper 202. The swirl generator device 201 includes a blowby gas flow inlet 203, a casing 204, an inner cylinder 05, a blowby gas outlet 206 and an oil drain valve 207. The blowby gas inlet 203, the casing 204, the inner cylinder 205, the blowby gas outlet 206 and the oil drain valve 207 of the swirl generator device 201 are secured on the head cover 107 by fastening screws or bolts. The casing 204 comprises a cylindrical section 208 and a taper section 209. The blowby gas inlet 203 is open to the side wall of the cylindrical section 208 with the axis thereon oriented at a tangent to the cylindrical section. The taper section 209 is provided with a flat bottom. A plurality of apertures 210 are formed in the flat bottom of the tapered section, at a center and in a circumferential alignment thereof. The aperture 210 positioned at the center of the flat bottom of the tapered section 209 is plugged by a generally mushroom-shaped oil drain valve 207 made of rubber. The stem portion 211 thereof is located within the aperture. The oil drain valve 207 is thus press-fitted to the flat bottom for closing the center aperture 210 in an oil-tight fashion. The oil drain valve 207 has a conical head 212 extending over the lower opening ends of the circumferentially arranged apertures 210, for closing same.

The drawing type trapper 202 includes a blowby gas inlet 213, an outlet 214, a cylindrical casing 215, and an oil drawing passage 216. The drawing type trapper 202 is fixed to the head cover 107 by taper screws in alignment with the blowby gas inlet 206. The blowby gas inlet 213 has a smaller diameter than that of the cylindrical casing 215. The blowby gas inlet 213 extends from the bottom of the inner peripheral wall of the cylindrical casing 215 to thus define an annular groove 217 between the outer periphery of the extended portion of the blowby gas inlet 213 and the inner side wall and inner bottom wall of the cylindrical casing 215. The oil drawing passage 216 opens to the annular groove 217. The orientation of the oil drawing passage 216 at the opening end is in the same direction as that of the circulation of the blowby gas flow generated by the swirl generating device 201. The blowby gas outlet 214 is in communication with the air induction passage 117 via the blowby gas recirculation passage 118, as shown in FIG. 1. The oil drawing passage 216 is also in communication with a vacuum pump 3 for a vacuum type brake booster 4.

Figure 3:
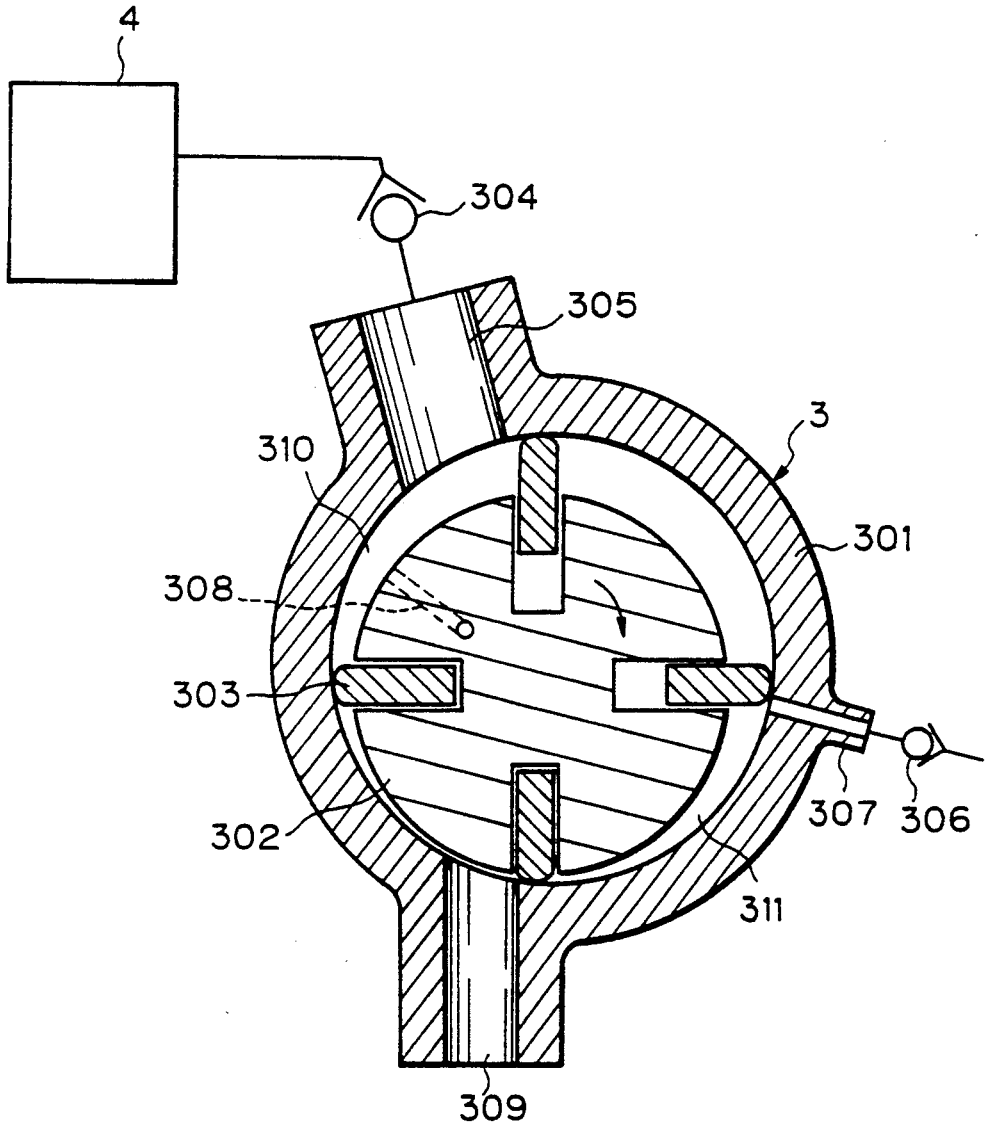
FIG. 3 is an enlarged section view of a vacuum pump in the first embodiment of FIG. 1.

The construction of the vacuum pump 3 is shown in FIG. 3. The vacuum pump 3 has a housing 301, an eccentric rotor 302, and a plurality of vanes 303. The eccentric rotor 302 has a rotary shaft common with a shaft for an alternator driven through a drive belt via a pulley on the crankshaft (not shown). The housing 301 is fixed to the alternator. The housing 301 has a cylindrical configuration and is in communication with a booster suction port 305 via a booster check valve 304. The oil drawing passage 216 of the drawing type trapper 202 communicates with a separator drawing port 307 through a non-return valve 306. The pressurized lubricant oil is supplied to a vacuum pump lubrication passage 308, through an engine lubrication line (not shown). Furthermore, the vacuum pump 3 has a drain opening 309 for draining the oil supplied through the vacuum pump lubrication passage 308, the air introduced through the booster check valve 304, and oil and air drawn through the drawing trapper 202. The drain opening 309 is in communication with the crank chamber 103 of the engine body 1. The separator drawing port 307 is positioned between the booster drawing port 305 and the drain opening 309 relative to the rotational direction of the eccentric rotor 302. It is not in direct communication with the booster drawing port 305 and the drain opening 309 via the chamber defined by the housing 301, the eccentric rotor 302 and the vanes 303.

Figure 2A:
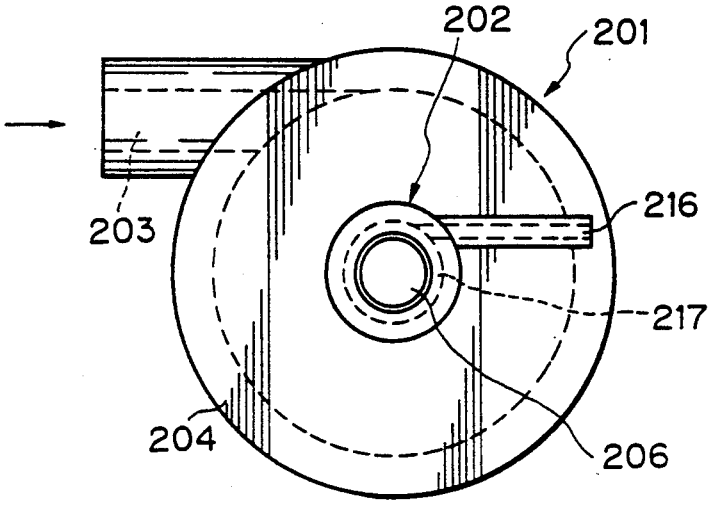
FIGS. 2(*a*) and 2(*b*) are enlarged illustrations of an oil separator in the first embodiment of FIG. 1, in which FIG. 2(*a*) is a plan view and FIG. 2(*b*) is a section view.
Figure 2B:
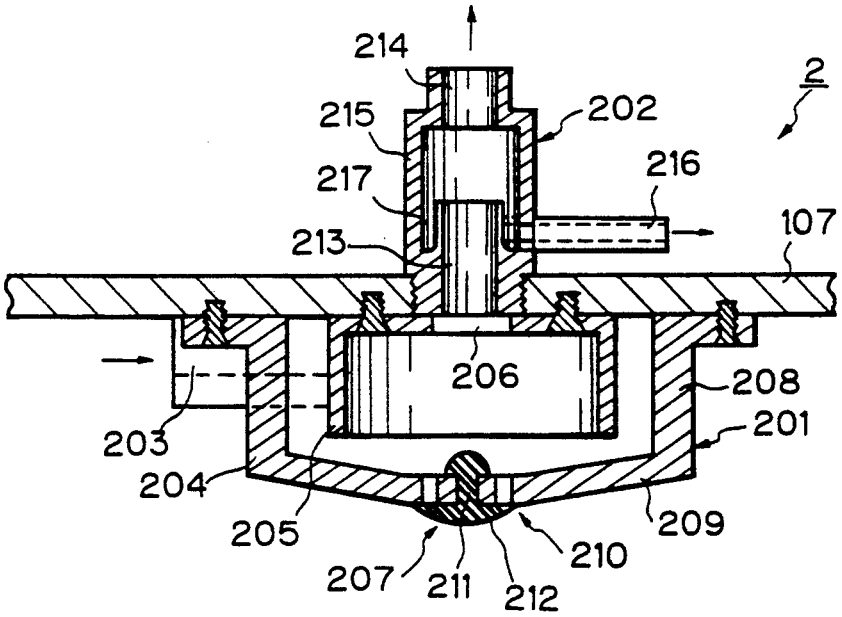

The blowby gas carrying the oil mist, entering the blowby gas chamber 115 from the crank chamber 103 via the oil return passage 114, flows into the blowby gas inlet 203 of the swirl generator device 201 of the oil separator 2, as shown in FIG. 2. Then, the blowby gas flows in a swirl downward along the inner periphery of the cylindrical section 208. The gas subsequently enters the drawing type trapper 202 through the blowby gas outlet 206. During the flow of the blowby gas in a swirl, most of the oil mist is separated from the blowby gas due to the inertial force exerted thereon. The oil mist thus separated from the flow of the blowby gas adheres to respective inner peripheries of the cylindrical section 208 of the casing 204, the inner cylinder 205, and the drawing type trapper 202, to form an oil film. The blowby gas and the oil film thus formed flow into the cylindrical casing 215 through the projected portion of the blowby gas inlet 213. At this time, due to an expansion of the diameter, a swirl is generated from the outer periphery of the blowby gas inlet 213 to the inner periphery of the cylindrical casing 215. With this swirl, the oil film is drawn up along the inner periphery of the blowby gas inlet 213 and then trapped within the annular groove 217, to be accumulated in the bottom of that groove. The blowby gas, from which the oil mist is removed, is introduced into the air induction passage 117 through the blowby gas output 214 and the blowby gas recirculation passage 118. Since the direction of the swirl generated by the swirl generator device 201 and the opening direction of the oil drawing passage 216 are oriented in the same tangential direction, a recovery of the oil trapped in the annular groove 217 can be smoothly carried out.

Next, an oil drawing operation by the vacuum pump 3 will be discussed. When the eccentric rotor 302 of the vacuum pump 3 is driven in the clockwise direction in FIG. 3, the volume of the drawing chamber 310, defined by the housing 301, the eccentric rotor 302 and the vane 303, is gradually expanded to cause a vacuum pressure. Therefore, a vacuum pressure is generated in the brake booster. As shown, the chamber 311 of the vacuum pump 3 is in the compression stroke. However, in the compression stroke, the pressure in the chamber 311 is still maintained in a vacuum condition relative to the atmospheric pressure, and maintained at a pressure lower than the pressure in the annular groove 217 of the drawing type trapper 202. Therefore, the oil accumulated in the annular groove 217 is drawn with a part of the blowby gas through the oil drawing passage 216, the non-return valve 306 and the separator drawing port 307. The oil drawn into the chamber 311 of the vacuum pump 3 is then recirculated to the crank chamber 103 through the drain opening 309 of the vacuum pump.

Note, the oil separated in the casing 204 of the swirl generator device 201 and adhering to the inner periphery of the casing is condensed and converged to the bottom of the casing along the taper section 209. When the amount accumulated in the bottom of the casing 204 becomes sufficient to overcome the elastic force maintaining the head portion 212 of the oil drain valve 207 in the closed position, i.e., closing the lower opening ends of the circumferentially arranged apertures 210, the force of gravity of the accumulated oil forces the head portion 212 of the drain valve to open. Thus, the oil flows into the oil collection chamber 106 through the gap formed.

Figure 4:
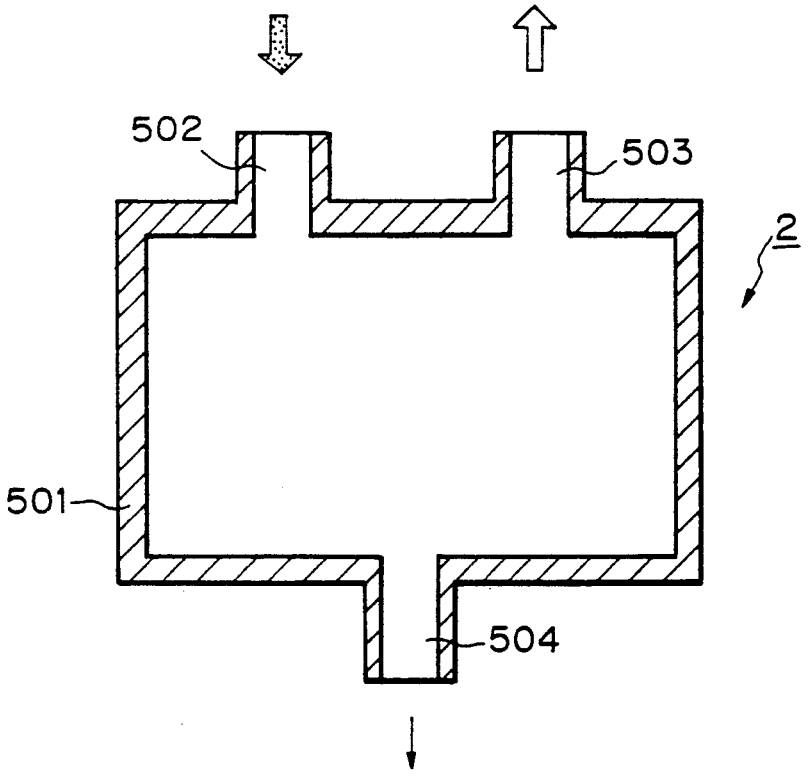
FIG. 4 is a longitudinal section view of the second embodiment of an oil separator of the present invention.

FIG. 4 shows the second embodiment of the oil separator 2 according to the present invention. In this embodiment, the oil separator comprises a cylindrical casing 501, a blowby gas inlet 502, a blowby gas outlet 503, and an oil drawing path 504. The blowby gas inlet 502 and the blowby gas outlet 503 are open in the upper wall of the casing 501. The oil drawing path 504 is open in the bottom of the casing. The blowby gas carrying the oil mist is slowed down due to expansion of the path area upon entry to the interior space of the casing 501. Due to a substantial lowering of the flow velocity, the oil mist carried with the blowby gas falls to the bottom of the casing, and is condensed thereon. The oil thus condensed on the bottom of the casing 501 is drawn by the vacuum pump 3 through the oil drawing path 504. The blowby gas, from which the oil mist is thus separated, flows through the blowby gas outlet 503 and then into the air induction passage 117. Therefore, the second embodiment of the oil separator 2 also effectively separates the oil mist from the blowby gas.

Figure 5A:
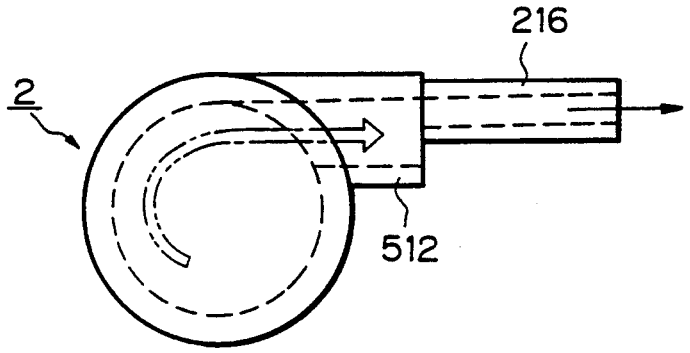
FIGS. 5(*a*) and 5(*b*) are enlarged illustrations of an oil separator in the third embodiment of the invention, in which FIG. 5(*a*) is a plan view and FIG. 5(*b*) is a longitudinal section.
Figure 5B:
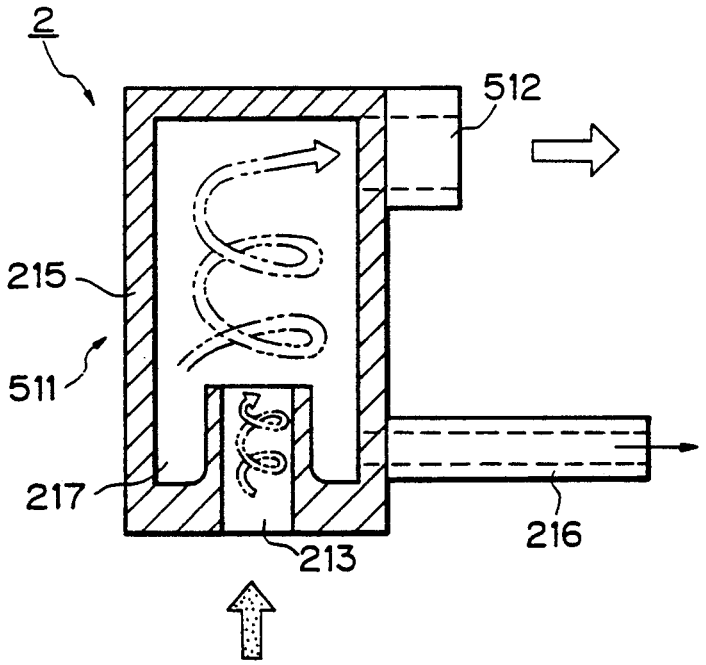

FIG. 5 shows the third embodiment of the oil separator 3 according to the present invention. In this embodiment, the oil separator comprises a cyclone type separator which may be considered equivalent to the construction incorporating the swirl generator device 201 in the first embodiment (FIG. 2) within the drawing type trapper 202. Namely, a drawing type trapper 511 has a blowby gas outlet 512 opening at a tangent to a cylindrical casing 215. Therefore, the blowby gas introduced into the interior space of the casing 215 generates a swirl flow directed toward a blowby gas outlet 512. The swirl flow of the blowby gas in the interior space of the casing 215 influences the oil mist carrying blowby gas flowing through the blowby gas inlet 213. As a result of swirl flow, and on the same principle as in the first embodiment, the oil mist carried by the blowby gas is separated from the blowby gas due to the inertia force and/or centrifugal force. The oil mist adheres to the inner peripheries of the blowby gas inlet 213 and the cylindrical casing 215. It is then collected in the annular groove 217. The oil trapped in the annular groove 217 is drawn by the vacuum pump 3 through the oil drawing passage 216, as in the first embodiment.

Figure 6:
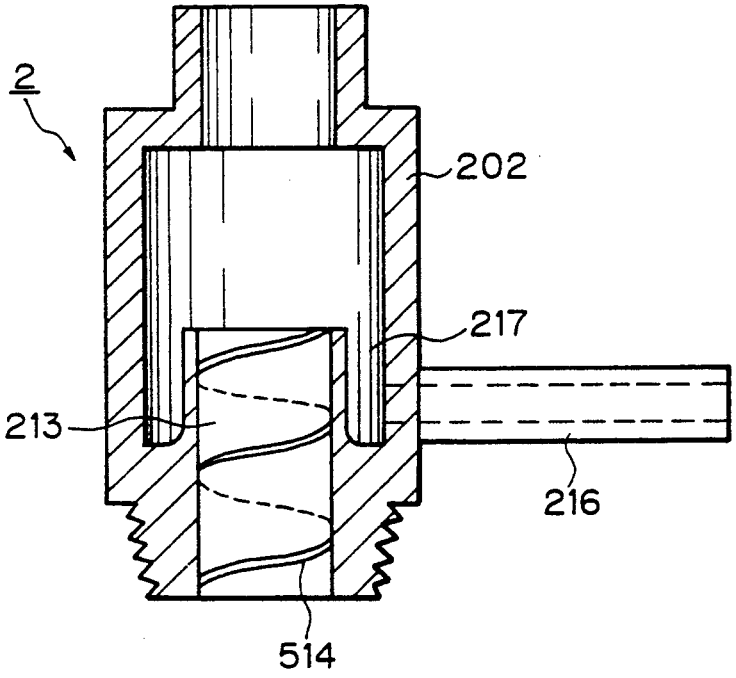
FIG. 6 is a longitudinal section view of the fourth embodiment of the invention.

FIG. 6 shows the fourth embodiment of the oil separator 2 according to the present invention. This embodiment is also directed to the cyclone type separator. A spiral groove 514 is formed on the inner periphery of the blowby gas inlet 213. In this embodiment, the blowby gas flowing through the blowby gas inlet 213 is guided by the spiral groove 514 to generate a swirl flow so that the oil mist carried therein can be separated from the gas with the centrifugal and/or inertia force. The oil mist is trapped within the annular groove 217. As in the first and third embodiments, the oil thus trapped within the annular groove is drawn out through the oil drawing passage 216 by the vacuum pump 3.

In the foregoing embodiments, the vane type vacuum pump cooperating with the alternator has been employed for drawing the trapped or collected oil, but the means for drawing the trapped oil is not specified to the specific construction of the vacuum pump shown, and can be of any suitable means. For example, a reciprocation type or diaphragm type vacuum pump. Also, instead of employing the vacuum pump, an oil pump of any known construction can be used to obtain the equivalent results.

Figure 7:
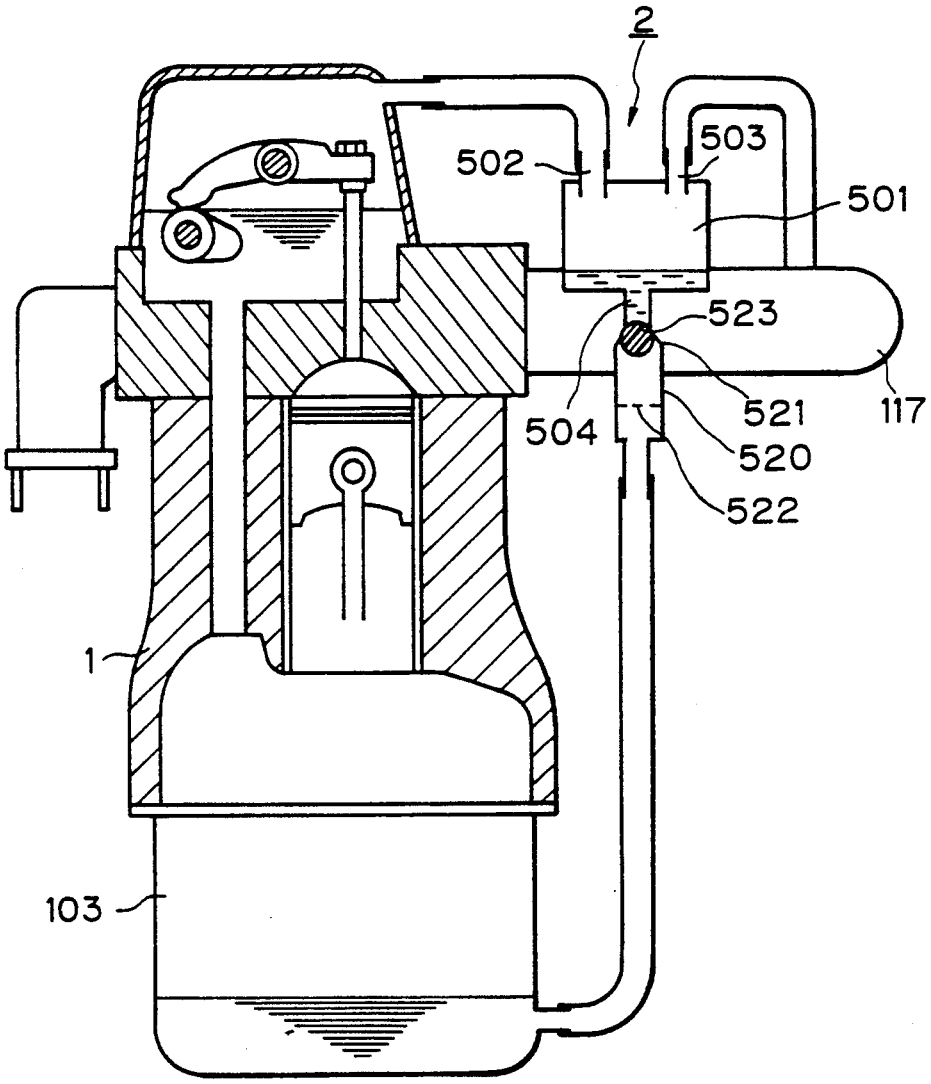
FIG. 7 is a longitudinal section view of the overall construction of the engine incorporating the fifty embodiment of the crankcase emission control system of the invention.

FIG. 7 shows the fifth embodiment of the crankcase emission control system according to the invention, in which a float valve 520 is employed in place of the vacuum pump in the former embodiments. In this embodiment, the oil separator 2 employed in the second embodiment of FIG. 4 is employed for trapping the oil mist carried by the blowby gas. The oil drawing path 504 in the cylindrical casing 501 is in communication with the crank chamber 103 though the float valve 520. The float valve comprises a float valve seat 521, a mesh form valve retainer plate 522, and a ball-shaped float 523 formed of nylon, for example. The ball-shaped float 523 is disposed between the float valve seat 521 and the mesh form valve retainer plate 522, for a free movement therebetween. With this construction, while the engine is running, since the pressure in the oil separator 2 is lower than the pressure in the crank chamber 103, the float valve 523 is held seated on the float valve seat 521 due to pressure difference, to block an oil flow from the oil separator 2 to the crank chamber 103. Therefore, during the engine operation, the oil is accumulated in the casing 501 of the oil separator. When the engine is stopped, the float valve 523 drops onto the mesh form valve retainer plate 522 to open the oil drawing path 504. As a result, due to the force of gravity, the oil flows into the crank chamber 103.

Figure 8:
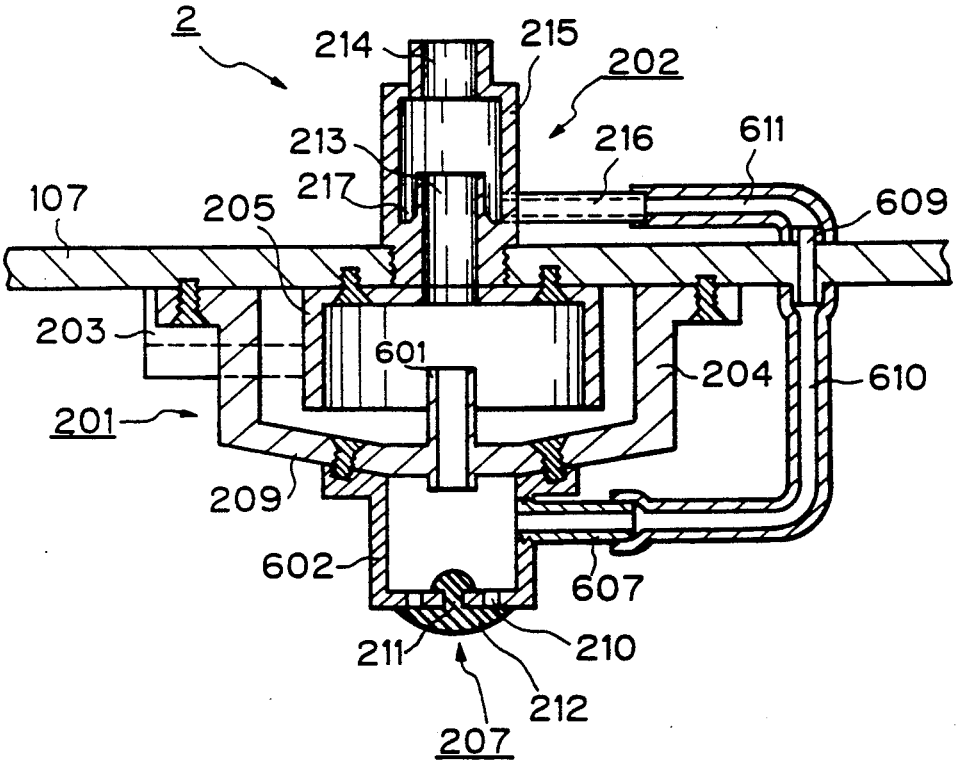
FIG. 8 is an enlarged section view of the sixth embodiment of the present invention.

FIG. 8 shows a sixth embodiment of the oil separator 2, which does not require an oil drawing means, such as the vacuum pump. In this embodiment, the oil separator 2 includes the cyclone type swirl generator device 201 and the drawing type trapper 202, as in the first embodiment of FIG. 2. A vacuum passage 601 has an upper end positioned within the interior space of the inner cylinder 205, and a lower end opens to an oil collection chamber 602 attached to the lower side of the swirl generator device 201. The interior space of the inner cylinder 205 and the oil collection chamber 602 are in communication with each other through this vacuum passage 601. A plurality of apertures 210 are formed through the bottom of the oil collection chamber 602, in the same manner as in the first embodiment of FIG. 2. The oil drain valve 207 has the same construction as in the first embodiment, and thus the stem 211 thereof extends through the center aperture 210. The valve head 212 elastically closes the lower opening ends of the circumferentially arranged apertures 210. Through the side wall of the oil collection chamber 602, an oil inlet port 607 is threadingly engaged to open into the interior space of the oil collection chamber. A communication port 609 is formed through the head cover 107, and the lower end of the communication port 609 is connected to the inlet port 607 through a drawing passage 610. The upper end of the communication port 609 is connected to the oil drawing passage 216, which opens into the annular chamber 217 of the drawing type oil trapper 202, through a drawing passage 611. Therefore, the annular groove 217 of the oil trapper 202 is in communication with the oil collection chamber 602 through the oil drawing passage 216, the drawing passage 611, the communication port 609, the drawing passage 610, and the inlet port 607.

The blowby gas carrying the oil mist is introduced into the interior space of the cylindrical casing 204 of the swirl generator device 201 in the tangential direction to generate a swirl flow of the blowby gas in the swirl generator device 201. Due to the swirl flow of the blowby gas, the oil mist carried by the blowby gas is separated therefrom by the centrifugal force and/or inertia force. The oil mist adheres to the inner peripheries of the casing 204, as discussed in the first embodiment. As in the first embodiment, the oil is thus trapped within the annular groove 217 in the drawing type oil trapper 202. Since the oil collection chamber 602 is in communication with the center of the interior space of the inner cylinder 205, where the vacuum pressure is generated due to the swirl flow of the blowby gas, the pressure in the oil collection chamber 602 is lowered. The pressure in the oil collection chamber 602 thus becomes lower than that in the annular groove 217 of the drawing type trapper 202. Accordingly, due to the pressure difference between the trapper 202 and the oil collection chamber 602, a partial flow of the blowby gas occurs through the oil drawing passage 216, the drawing port 611, the communication port 609, the drawing passage 610 and the inlet port 607 and into the oil collection chamber 602. The oil trapped in the annular groove 217 is carried by this flow of the blowby gas to enter the oil collection chamber 602.

Since the flow velocity of the blowby gas is lowered in the oil collection chamber 602, the oil is separated from the blowby gas to be accumulated therein. The blowby gas in the oil collection chamber 602 flows through the vacuum passage 601 into the interior space of the inner cylinder 205. As in the first embodiment, the oil accumulated in the oil collection chamber 602 opens the circumferentially arranged apertures 210 an elastic deformation of the valve head section 212 of the oil drain valve 207, to be returned to the head cover while the engine is not running. In this embodiment, since the oil trapped in the annular groove 217 can be fed into and collected in the oil collection chamber 602, utilizing the vacuum generated by the swirl flow of the blowby gas generated by the swirl generator device 201, it is unnecessary to employ a specific pump, etc. With the construction shown, since only a little oil can be held within the annular groove 217 in the drawing type oil trapper 202, the trapper can always be operated at an optimal condition.

Figure 9A:
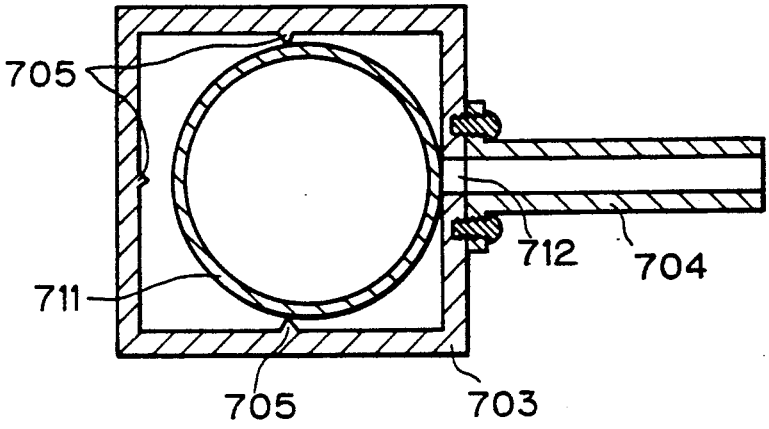
FIGS. 9(*a*) and 9(*b*) show the seventh embodiment of the invention, in which FIG. 9(*a*) shows a sectional plan view sectioned along line A—A of FIG. 9(*b*), and FIG. 9(*b*) is a longitudinal section.
Figure 9B:
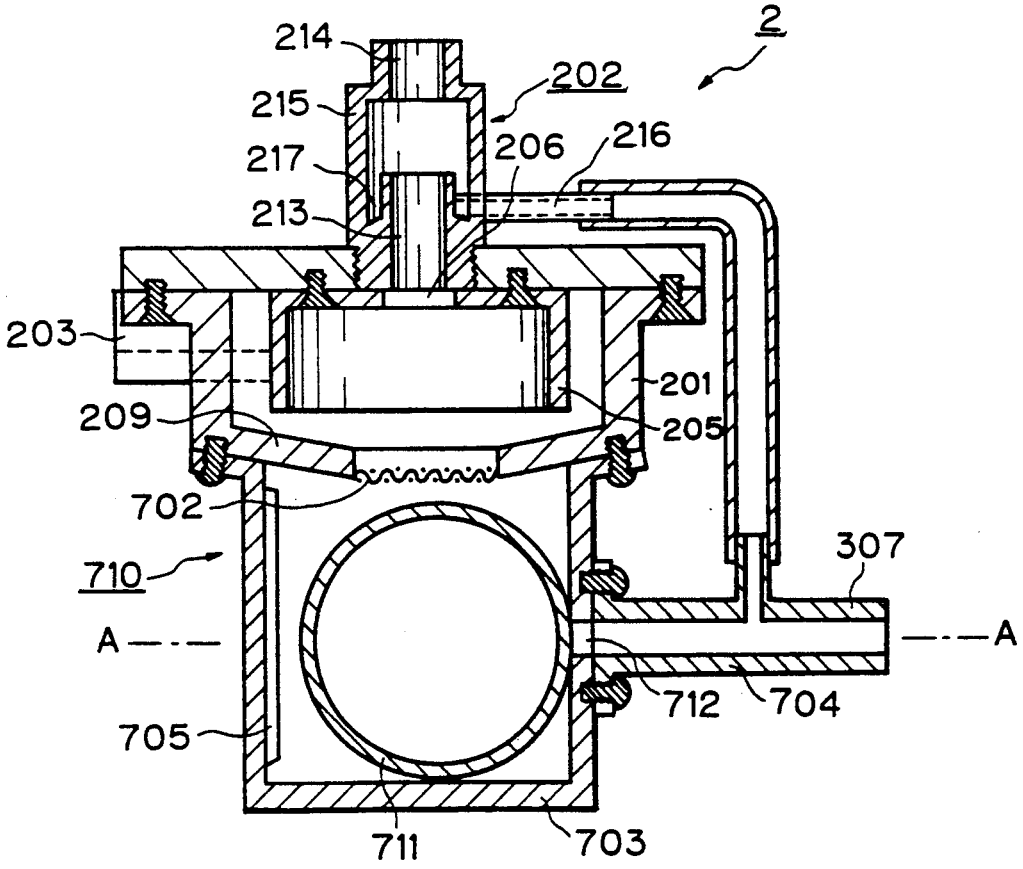

FIG. 9 shows the seventh embodiment of the oil separator 2, in which the vacuum pump 3 and the float valve assembly 710 are employed in combination. In this embodiment, the oil separator 2 has generally the same construction as in the first embodiment of FIG. 2. The bottom of the tapered section 209 of the swirl generator device 201 is open to a float valve chamber 703, which is attached to the swirl generator device 201 by fastening screws. The float valve assembly includes a float 711, a mesh 702, and an essentially rectangular or square box-shaped float valve chamber 703 in communication with the taper section 209 of the swirl generator device 201. The float 711 is formed into a hollow ball-shaped configuration and positioned within the float valve housing for a free movement therein. From the inner periphery of three side walls, except for the side wall through which an oil drain port 712 is formed, projection 705 with essentially triangular configuration in cross section are extended. The drain port 712 is in communication with an oil drain passage 704 which is rigidly secured to the side wall by fastening screws. The oil drain passage 704 is in communication with the oil drawing passage 216 and with the vacuum pump 3 for the brake booster 4. (See FIGS. 1 and 3)

When a relatively large amount of oil is introduced into the oil separator, most of the oil is separated from the swirl generator device 201 and flows into the interior space of the float valve housing 703. In a normal engine driving condition, the float 711 is drawn by the vacuum pressure of the vacuum pump 3 and thus seated on the side wall of the housing 703 to close the drain port 712. When the amount of oil accumulated in the float valve housing 703 is increased to more than a predetermined level, the float 711 floats on the accumulated oil overcoming the drawing force of the vacuum pump. Therefore, the drain port 712 is opened to permit the accumulated oil in the float valve housing 703 to flow through the oil drain passage 704 by the vacuum pressure of the vacuum pump 3. If the oil level is thus lowered across the predetermined oil level the float 71 again blocks the drain port 712.

With the construction shown, extra or an unnecessary amount of air is prevented from entering the vacuum pump 3. Thus, an excessively high pressure in the crank casing is prevented. Note, in the embodiment shown, the mesh 702 is provided to prevent the float from rising too high and blocking the opening bottom of the swirl generator device 201. The mesh, therefore, maintains a constant communication between the swirl generator device 201 and the float valve housing 703. Also, the projections 705 projecting from the inner periphery of the float valve housing 703 prevent the sticking of the float 711 to one peripheral surface, to thus be made inoperative.

Although the present invention has been discussed in terms of various specific embodiments of the invention, various modifications and changes including changes of detailed constructional components, additions of other elements, or an omission of certain elements, will be obvious to those skilled in the art, for a practical implementation of the invention. Therefore, the invention should be considered to include all possible implementations which can be embodied without departing from the principle of the invention defined in the appended claims.

We claim:

1. A gas/liquid separation apparatus comprising:

first passage means for passing therethrough a gas carrying a liquid component;

swirl generator means, disposed on an upstream side said first passage means, for separating said liquid component from said gas with a swirl flow of said gas, thereby generating a vacuum pressure;

first liquid accumulation means, disposed on said first passage means and on a downstream side of said swirl generator means, for trapping and accumulating said separated liquid component, said first liquid accumulation means having an annular groove surrounding said first passage means which traps and accumulates said separated liquid component, such that said liquid component does not pass through said first liquid accumulation means;

second liquid accumulation means for drawing in and accumulating said separated liquid component accumulated in said annular groove of said first liquid accumulation means based on a difference in said vacuum pressure between said first liquid accumulation means and said second liquid accumulation means;

second passage means, connecting said annular groove to said second liquid accumulation means, for passing therethrough said accumulated separated liquid component; and third passage means, connecting said second liquid accumulation means to a center portion of said swirl flow for communicating therethrough said vacuum pressure.

2. A gas/liquid separation apparatus as claimed in claim 1, wherein said third passage means connects said second liquid accumulation means to said center portion of said swirl generator means and projects upwardly through a bottom portion of said swirl generator means.

3. A gas/liquid separation apparatus as claimed in claim 2, wherein one end said second passage means opens tangential to said annular groove of said first liquid accumulation means in the same direction as that of said swirl flow of said gas generated by said swirl generator means.

4. A gas/liquid separation apparatus as claimed in claim 2, wherein said second liquid accumulation means includes blocking means, disposed on a bottom portion of said second liquid accumulation means, for closing when an internal pressure of said second liquid accumulation means is lower than an exterior pressure based on said vacuum pressure.

5. A gas/liquid separation apparatus as claimed in claim 1, wherein one end said second passage means opens tangential to said annular groove of said first liquid accumulation means in the same direction as that of said swirl flow of said gas generated by said swirl generator means.

6. A gas/liquid separation apparatus as claimed in claim 5, wherein said second liquid accumulation means includes blocking means, disposed on a bottom portion of said second liquid accumulation means, for closing when an internal pressure of said second liquid accumulation means is lower than an exterior pressure based on said vacuum pressure.

7. A gas/liquid separation apparatus as claimed in claim 1, wherein said second liquid accumulation means includes blocking means, disposed on a bottom portion of said second liquid accumulation means, for closing when an internal pressure of said second liquid accumulation means is lower than an exterior pressure based on said vacuum pressure.

* * * * *